US010165351B2

(12) United States Patent
Imai et al.

(10) Patent No.: US 10,165,351 B2
(45) **Date of Patent: *Dec. 25, 2018**

(54) HEADPHONE

(71) Applicants: SINTAI OPTICAL (SHENZHEN) CO., LTD., Shenzhen, Guandong Province (CN); ASIA OPTICAL INTERNATIONAL LTD., Tortola (VG)

(72) Inventors: Naofumi Imai, Taichung (TW); Takayuki Karasawa, Taichung (TW); Tomoya Takahashi, Taichung (TW)

(73) Assignees: SINTAI OPTICAL (SHENZHEN) CO., LTD., Shenzhen, Guangdong Province (CN); ASIA OPTICAL INTERNATIONAL LTD., Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 15/292,796

(22) Filed: Oct. 13, 2016

(65) Prior Publication Data

US 2017/0214999 A1 Jul. 27, 2017

(30) Foreign Application Priority Data

Jan. 27, 2016 (CN) ..... 2016 1 0055454

(51) Int. Cl.
*H04R 3/14* (2006.01)
*H04R 1/26* (2006.01)
(Continued)

(52) U.S. Cl.
CPC ..... *H04R 1/1075* (2013.01); *H04R 1/1008* (2013.01); *H04R 1/26* (2013.01);
(Continued)

(58) Field of Classification Search
CPC ..... H04R 1/1075
See application file for complete search history.

(56) References Cited

U.S. PATENT DOCUMENTS 4,005,278 A * 1/1977 Gorike ..... H04R 5/033 181/137
2001/0005422 A1* 6/2001 Nakamura ..... H04R 1/2819 381/349

(Continued)

FOREIGN PATENT DOCUMENTS

CN 204069266 U 12/2014
CN 103067827 B 5/2015

OTHER PUBLICATIONS

TW Office Action dated Feb. 10, 2017 in Taiwan application (No. 105102457).

*Primary Examiner* — Matthew Eason
*Assistant Examiner* — Phan Le
(74) *Attorney, Agent, or Firm* — McClure, Qualey & Rodack, LLP

(57) ABSTRACT

A headphone is provided. The headphone includes a housing, a first speaker and a second speaker. The housing includes a sound output side, a first layer structure, a first output path, a first trench, a first recess, and a second recess. The first speaker is disposed in the first recess, wherein the first speaker includes a first speaker orientation, and the first speaker orientation corresponds to the first output path. The second speaker is disposed in the second recess. The first output path includes the first trench, which is located at the first layer structure, that extends around the first speaker, and is connected to the sound output side.

19 Claims, 11 Drawing Sheets

(51) Int. Cl.

| | |
|---|---|
| ***H04R 1/10*** | (2006.01) |
| ***H04R 1/32*** | (2006.01) |
| *H04R 1/24* | (2006.01) |
| *H04R 1/28* | (2006.01) |
| *H04R 5/033* | (2006.01) |

(52) U.S. Cl.
CPC ..... *H04R 1/323* (2013.01); *H04R 3/14* (2013.01); *H04R 1/24* (2013.01); *H04R 1/2811* (2013.01); *H04R 1/2857* (2013.01); *H04R 5/033* (2013.01); *H04R 2205/022* (2013.01)

(56) References Cited

U.S. PATENT DOCUMENTS

2004/0218775 A1* 11/2004 Huang ..... H04R 1/1075 381/371
2013/0336512 A1* 12/2013 Kim ..... H04R 1/1016 381/380

* cited by examiner

HEADPHONE

CROSS REFERENCE TO RELATED APPLICATIONS

This Application claims priority of China Patent Application No. 201610055454.8, filed on Jan. 27, 2016, the entirety of which is incorporated by reference herein.

BACKGROUND OF THE INVENTION

Field of the Invention

The present invention relates to a headphone, and in particular to a multi-channel headphone.

Description of the Related Art

Conventional multi-channel headphones have a cover, a subwoofer speaker, a plurality of single channel cases, and a plurality of single channel speakers. The single channel cases are disposed in the cover, and the subwoofer speaker is also disposed in the cover. The cover is utilized as a resonance case. The single channel speakers are respectively disposed on the single channel cases. The multi-channel headphone provides sound output of at least four channels and the two subwoofer channels.

However, a conventional multi-channel headphone simply provides monotonous sound output. Additionally, the speakers of the conventional multi-channel headphone are located on the same level, which cannot realize a diversified sound environment and the spatial sense of the sound field.

BRIEF SUMMARY OF THE INVENTION

In one embodiment, a headphone is provided. The headphone includes a housing, a first speaker, and a second speaker. The housing includes a sound output side, a first layer structure, a first output path, a first trench, a first recess, and a second recess. The first speaker is disposed in the first recess, wherein the first speaker comprises a first speaker orientation, and the first speaker orientation corresponds to the first output path. The second speaker is disposed in the second recess. The first output path comprises the first trench, which is located at the first layer structure, that extends around the first speaker, and is connected to the sound output side.

In one embodiment, the housing further comprises a second output path, a second layer structure and a cover structure, the first speaker comprises a second speaker orientation, wherein the second speaker orientation corresponds to the second output path, and the first recess and the second recess are disposed in the second layer structure.

In one embodiment, the headphone further comprises a crossfeed speaker, wherein the crossfeed speaker comprises a crossfeed speaker orientation, the crossfeed speaker orientation corresponds to a crossfeed output path, and the first speaker, the second speaker and the crossfeed speaker are disposed between the first and second layer structures.

In one embodiment, the housing further comprises a third output path and a fourth output path, the second speaker comprises a third speaker orientation and a fourth speaker orientation, the first speaker and the second speaker are arranged at a tilt, the third and fourth speaker orientation respectively correspond to the third and fourth output path, and the lengths of the first and third output paths are respectively longer than the lengths of the second and fourth output paths.

In one embodiment, the second layer structure comprises a third recess, the first recess comprises a first inclined surface, the second recess comprises a second inclined surface, the first speaker in the first recess is in contact with the first inclined surface, the second speaker in the second recess is in contact with the second inclined surface, and the crossfeed speaker is disposed in the third recess.

In one embodiment, the first speaker, the second speaker and the crossfeed speaker are respectively attached in the first recess, the second recess and the third recess by magnetic force.

In one embodiment, the crossfeed output path extends between the second layer structure and the cover structure, and passes the second layer structure and the first layer structure to the sound output side, and the second layer structure comprises an opening portion, a second trench and a first through hole, the opening portion corresponds to the crossfeed speaker, the second trench communicates with the opening portion and the first through hole, and the crossfeed output path extends along the opening portion, the second trench and the first through hole, and leaves the second layer structure.

In one embodiment, the cover structure comprises a sound chamber, the sound chamber communicates with the opening portion and the second trench, the crossfeed output path extends along the opening portion, the sound chamber, the second trench and the first through hole, and leaves the second layer structure.

In one embodiment, the first layer structure comprises a second through hole, the second through hole corresponds to the first through hole, and the crossfeed output path travels from the second layer structure, passing the first layer structure to the sound output side along the first through hole and the second through hole.

In one embodiment, the first layer structure comprises a third through hole, the third through hole is connected to the first trench, and the first output path travels along the first trench and the third through hole to leave the first layer structure.

In one embodiment, the first layer structure further comprises a third trench and a fourth through hole. The third trench extends around the second speaker and is connected to the fourth through hole, and the third output path travels along the third trench and the fourth through hole to leave the first layer structure.

In one embodiment, at least a portion of the third trench extends around the first speaker.

In one embodiment, the third through hole is adjacent to the fourth through hole.

In one embodiment, the second through hole is located between the first speaker and the second speaker.

In one embodiment, the first speaker is located between the second through hole and the third through hole.

In one embodiment, the first trench comprises a comb-shaped portion. The comb-shaped portion, the second through hole, the third through hole and the fourth through hole are arranged around the first speaker.

In one embodiment, the second output path extends in the first layer structure and passes through the first layer structure to the sound output side.

In one embodiment, the first speaker provides a low pitch sound, the second speaker provides a high pitch sound, the crossfeed speaker provides a crossfeed sound, and the crossfeed sound is synthesized by the low pitch sound and the high pitch sound.

In one embodiment, the sound output side has a sound field center, and the sound field center is located in front of an ear canal.

Utilizing the headphone of the embodiment of the invention with the crossfeed speaker, both the left ear and the right ear of the user can hear the sound of the right sound channel and the left sound channel. The design of the path length, as well as the shapes of the first trench, the second trench and the third trench, modify the time difference of the sound therein. Additionally, the frequency can be modified by the design of breathable holes and the first trench.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
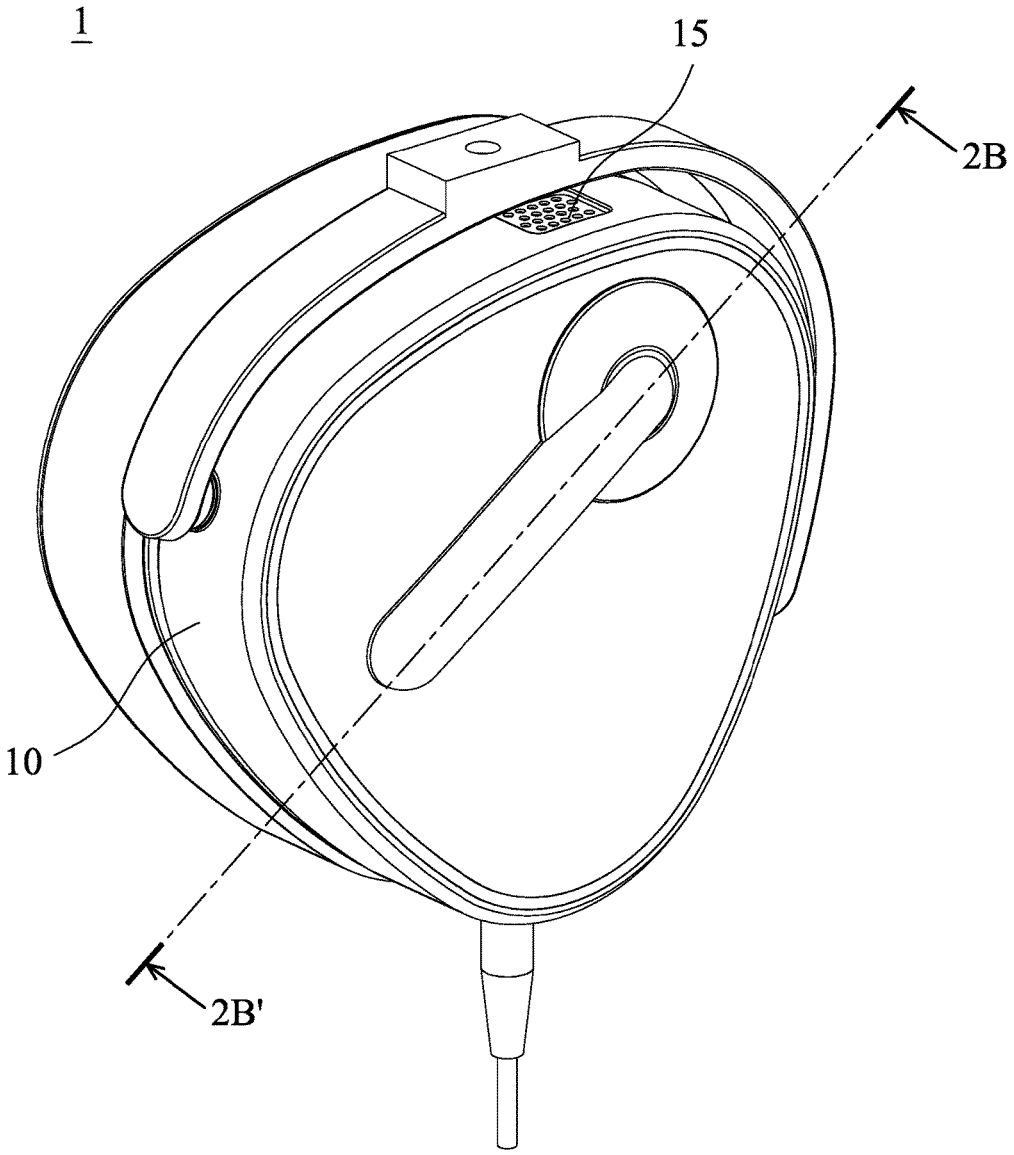
FIG. 1A is an assembled view of a headphone of an embodiment of the invention.
Figure 1B:
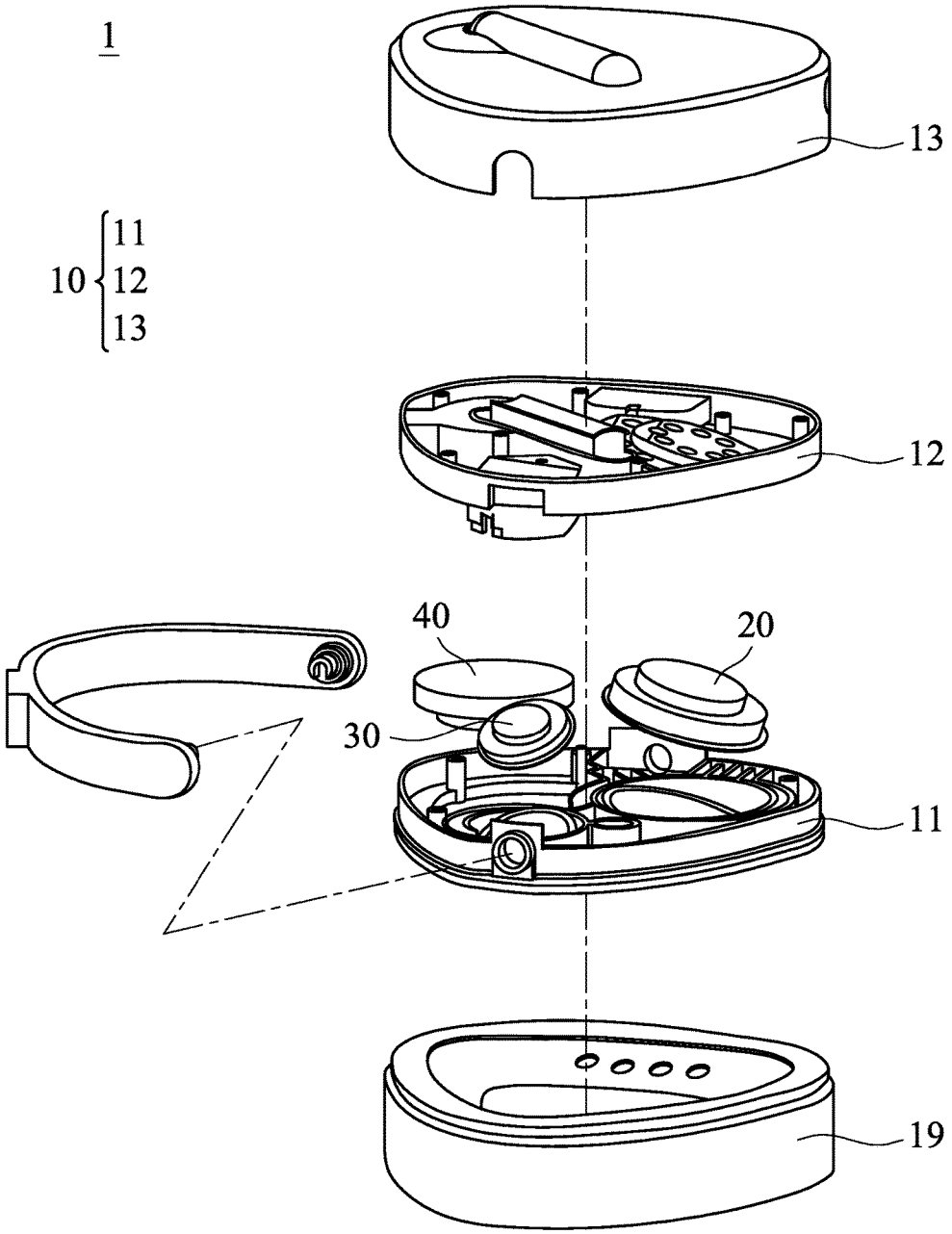
FIG. 1B is an exploded view of the headphone of the embodiment of the invention.

FIGS. 1A and 1B show a headphone 1 of an embodiment of the invention. The headphone 1 includes a housing 10, a low pitch speaker (first speaker) 20, a low pitch auxiliary path (first output path), a high pitch speaker (second speaker) 30, a high pitch auxiliary path (third output path), a crossfeed speaker 40 and a crossfeed output path. The housing 10 comprises a cover 13, a first layer structure 11, a second layer structure 12 and a sound output side 19. The second layer structure 12 is disposed between the first layer structure 11 and the cover structure 13. The first layer structure 11 is disposed between the second layer structure 12 and the sound output side 19. The low pitch speaker 20 is disposed between the second layer structure 12 and the first layer structure 11, and provides a low pitch sound. At least a portion of the low pitch sound travels from the low pitch speaker 20, passing through the low pitch auxiliary path, and is output through the sound output side 19. The high pitch speaker 30 is disposed between the second layer structure 12 and the first layer structure 11, and provides a high pitch sound. At least a portion of the high pitch sound travels from the high pitch speaker 30, passing through the high pitch auxiliary path 31, and is output through the sound output side 19. The crossfeed speaker 40 is disposed between the second layer structure 12 and the first layer structure 11, and provides a crossfeed sound. The crossfeed sound travels from the crossfeed speaker 40, passing through the crossfeed output path, and is output through the sound output side 19.

Figure 2A:
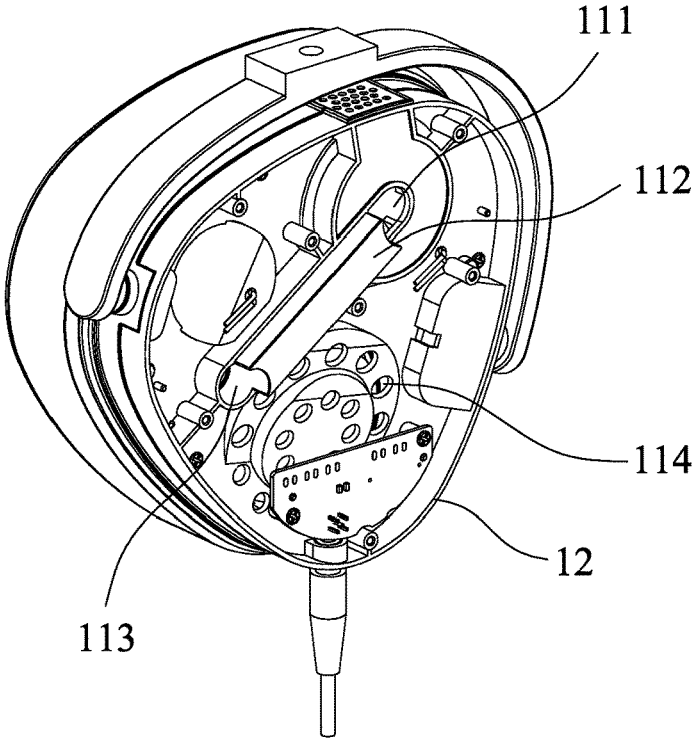
FIG. 2A shows a detailed structure of a second layer structure of the embodiment of the invention.
Figure 2B:
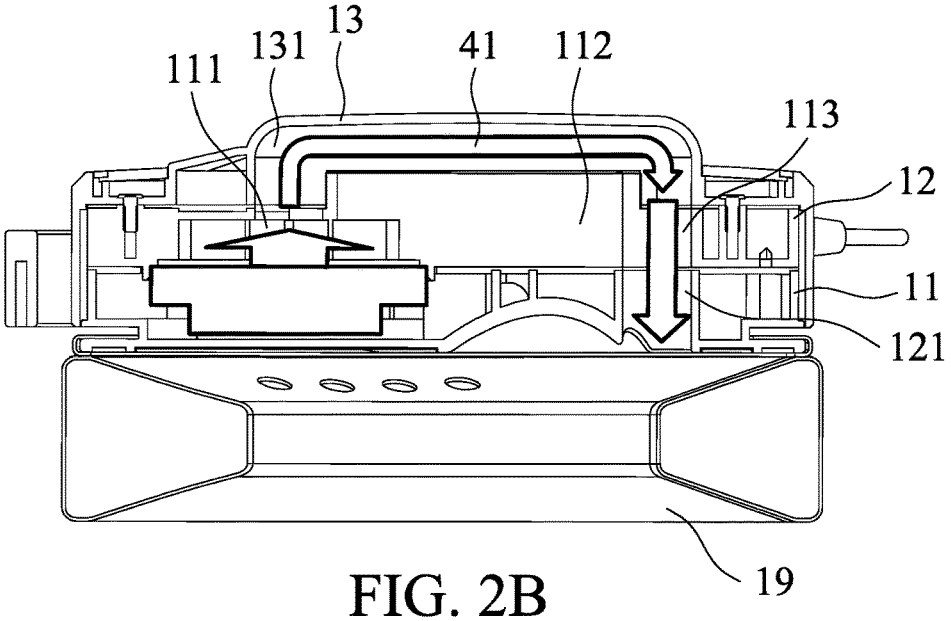
FIG. 2B is a cross sectional view along 2B-2B' direction of FIG. 1A.

FIG. 2A shows a detailed structure of the second layer structure 12, wherein the crossfeed output path 41 extends on the second layer structure 12, and passes through the second layer structure 12 and the first layer structure 11 to the sound output side 19. The second layer structure 12 includes an opening portion 111, a protrusion 112 and a first through hole 113. The opening portion 111 corresponds to the crossfeed speaker 40. With reference to FIG. 2B, which is a sectional view along 2B-2B' direction of FIG. 1A, the cover structure 13 comprises a second trench 131 corresponding to the opening portion 111, the protrusion 112 and the first through hole 113. The crossfeed output path 41 extends along the opening portion 111, the second trench 131 and the first through hole 113 to leave the second layer structure 12. The first layer structure 11 comprises a second through hole 121 corresponding to the first through hole 113. The crossfeed output path 41 travels from the second layer structure 12, passing the first layer structure 11 to the sound output side 19 along the first through hole 113 and the second through hole 121.

In this embodiment, the second trench 131 is a straight-line shaped trench.

With reference to FIG. 2A, in one embodiment, the second layer structure 12 further comprises a plurality of vents 114, and the vents 114 correspond to the low pitch speaker 20.

Figure 3A:
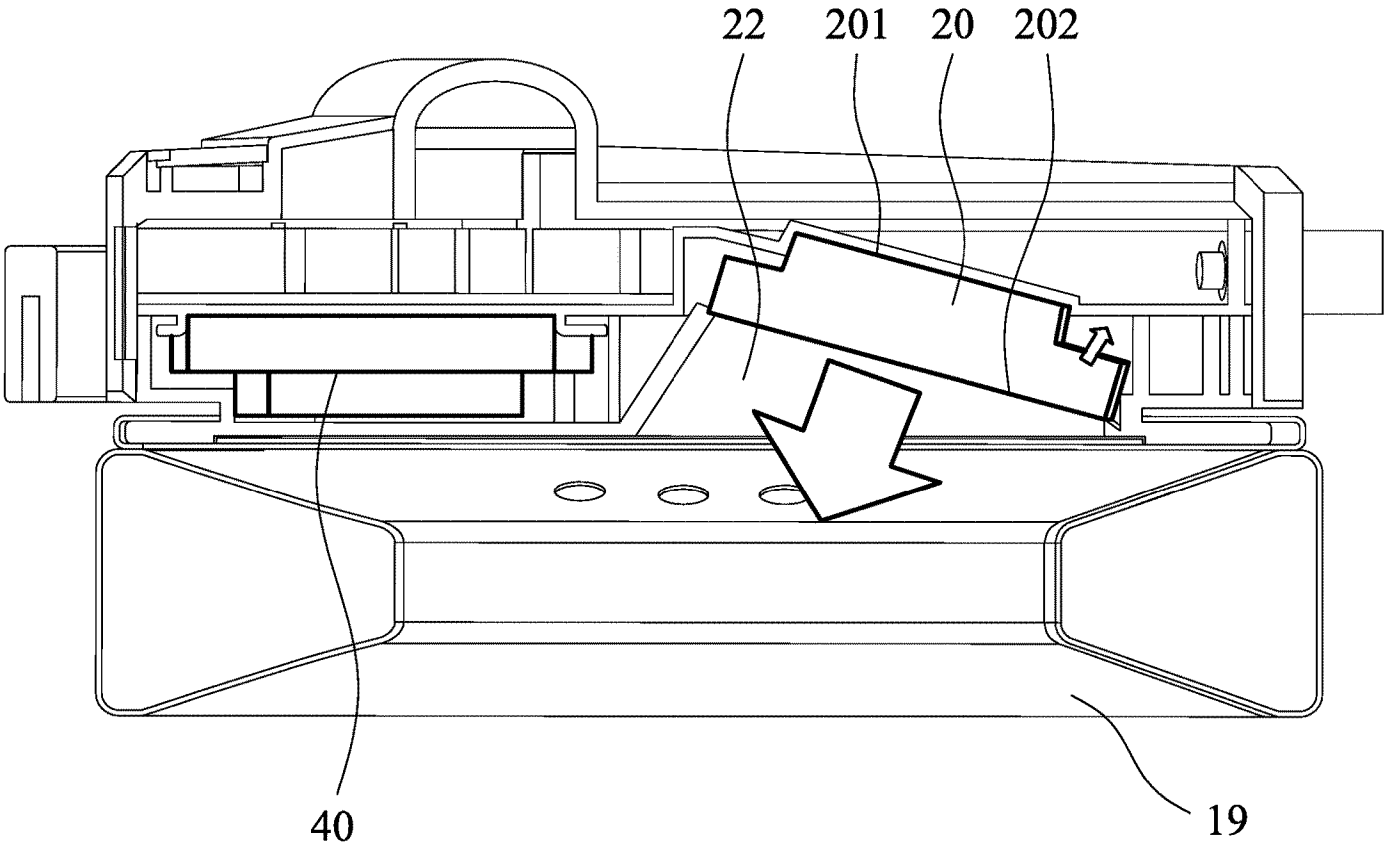
FIG. 3A shows a low pitch speaker and a low pitch major path of the embodiment of the invention.
Figure 3B:
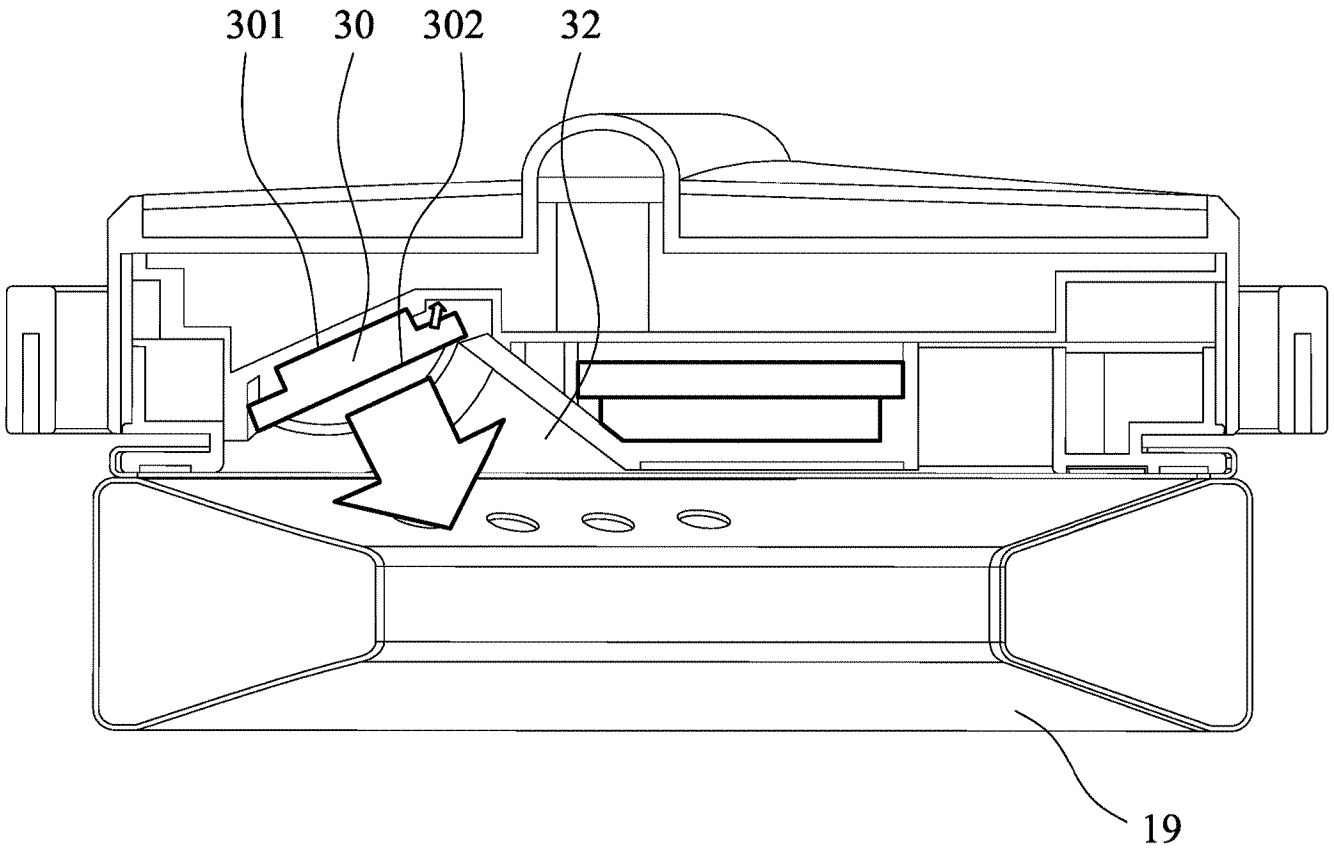
FIG. 3B shows a high pitch speaker and a high pitch major path of the embodiment of the invention.

With reference to FIGS. 3A and 3B, the inclined low pitch speaker 20 has a first speaker surface 201 and a second speaker surface 202. The first speaker surface 201 corresponds to the low pitch auxiliary path (first output path). The second speaker surface 202 outputs at least a portion of the low pitch sound toward the sound output side 19 via a low pitch major path (second output path) 22. The inclined high pitch speaker 30 has a third speaker surface 301 and a fourth speaker surface 302. The third speaker surface 301 corresponds to the high pitch auxiliary path. The fourth speaker surface 302 outputs at least a portion of the high pitch sound toward the sound output side 19 via a high pitch major path (fourth output path) 32. A portion of the low pitch sound of the low pitch speaker 20, due to the inclined design of the low pitch speaker 20, passes through the low pitch auxiliary path 21 to the sound output side 19. A portion of the high pitch sound of the high pitch speaker 30, due to the inclined design of the high pitch speaker 30, passes through the high pitch auxiliary path 31 to the sound output side 19 to generate stereo sound. The length of the low pitch auxiliary path 21 is much longer than that of the low pitch major path 22. The length of the high pitch auxiliary path 31 is much longer than that of the high pitch major path 32.

Figure 3C:
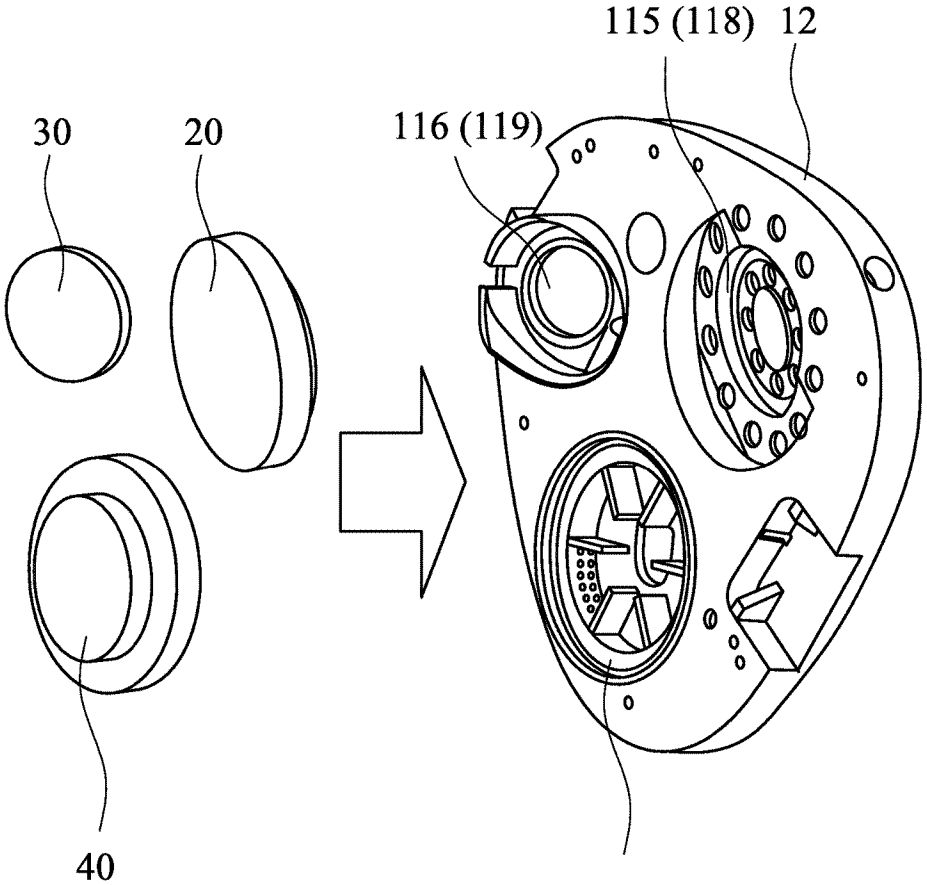
FIG. 3C shows the low pitch speaker, the high pitch speaker and a crossfeed speaker of the embodiment of the invention.

FIG. 3C shows the low pitch speaker 20, the high pitch speaker 30 and the crossfeed speaker 40 being fixed. The second layer structure 12 comprises a first recess 115, a second recess 116 and a third recess 117. The first recess 115 includes a first inclined surface 118. The second recess 116 comprises a second inclined surface 119. The low pitch speaker 20 is embedded into the first recess 115 and is in contact with the first inclined surface 118. The high pitch speaker 30 is embedded into the second recess 116 and is in contact with the second inclined surface 119. The crossfeed speaker 40 is embedded into the third recess 117. In this embodiment, the low pitch speaker 20, the high pitch speaker 30 and the crossfeed speaker 40 are respectively attached to the first recess 115, the second recess 116 and the third recess 117 via magnetic force.

Figure 4A:
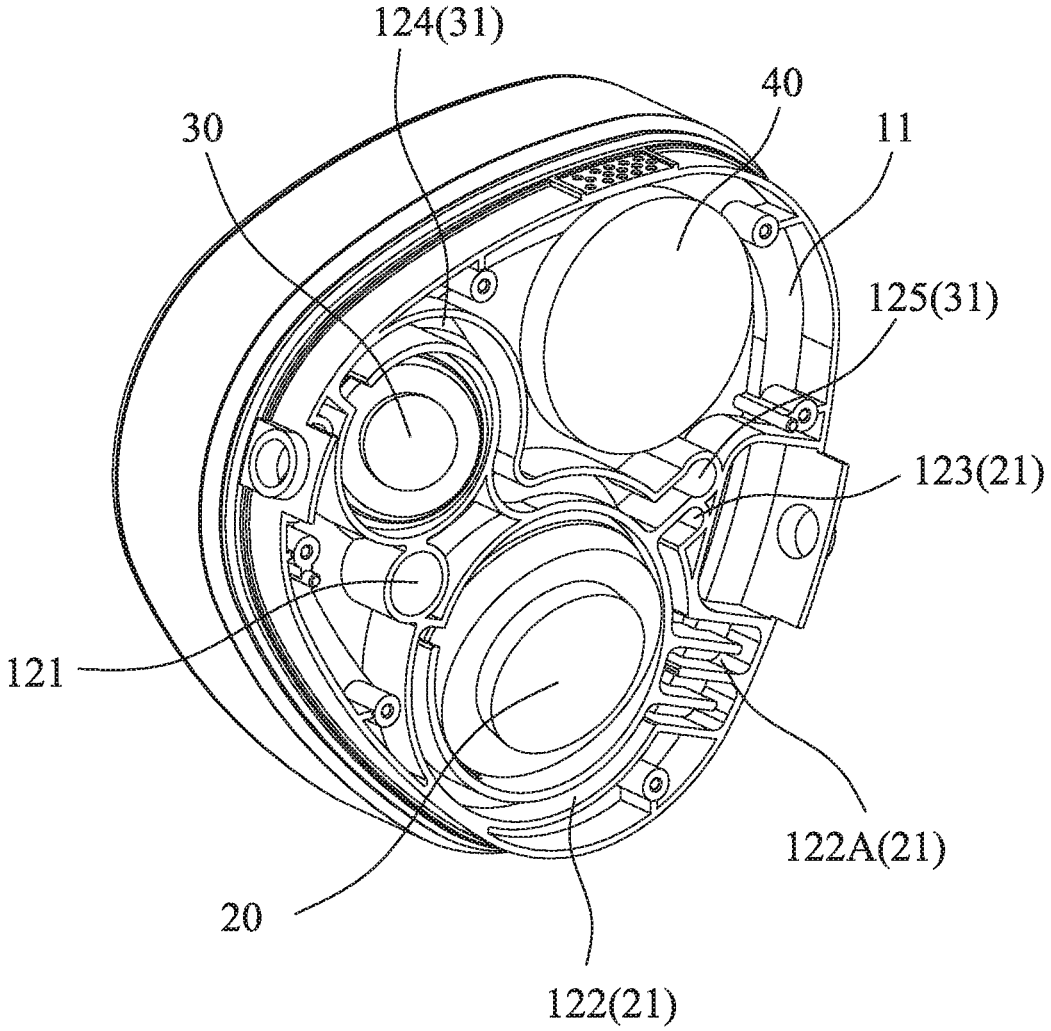
FIGS. 4A and 4B show a detailed structure of a first layer structure of the embodiment of the invention.
Figure 4B:
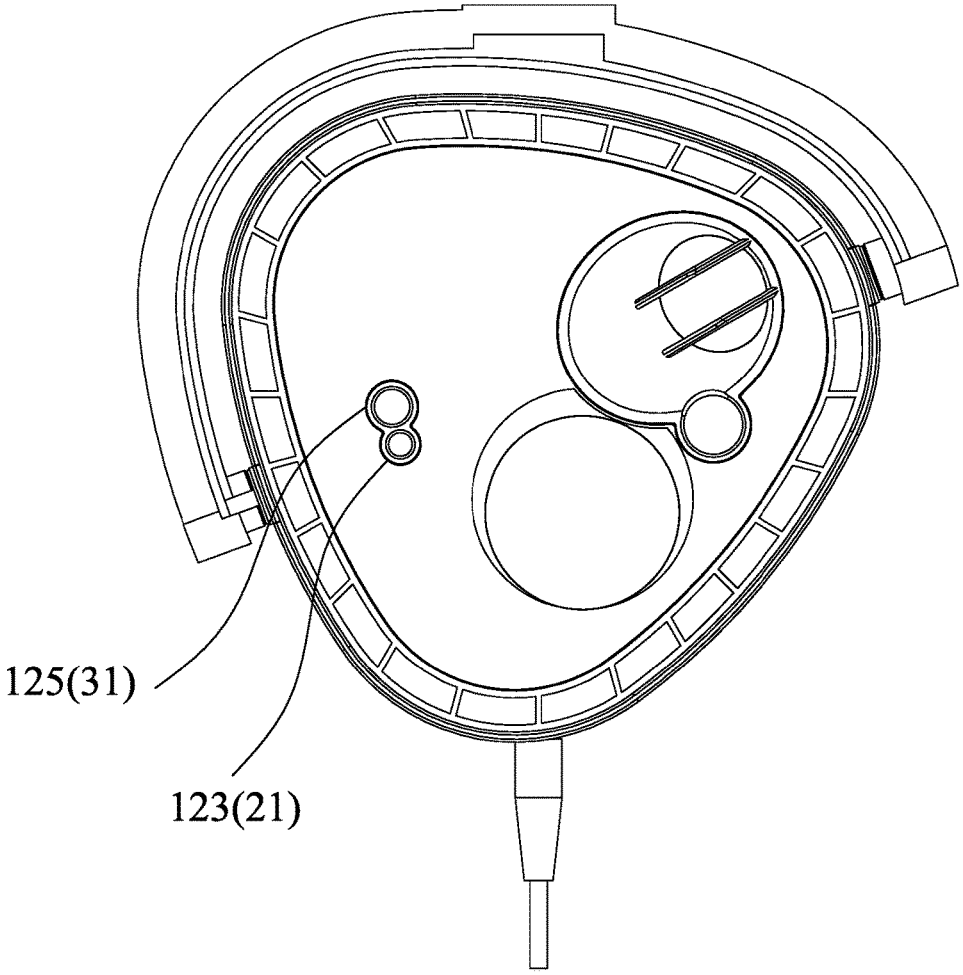

FIGS. 4A and 4B show a detailed structure of the first layer structure 11, wherein the low pitch auxiliary path 21 extends in the first layer structure 11, and passes through the first layer structure 11 to the sound output side 19. The first layer structure 11 includes a first trench 122 and a third through hole 123. At least a portion of the first trench 122 extends around the low pitch speaker 20 and is connected to the third through hole 123. The low pitch auxiliary path 21 extends along the first trench 122 and the third through hole 123, and leaves the first layer structure 11.

In one embodiment, the first trench 122 includes a comb-shaped portion 122A, and the comb-shaped portion 122A delays the transmission of the sound.

With reference to FIGS. 4A and 4B, the first layer structure 11 includes a third trench 124 and a fourth through hole 125. At least a portion of the third trench 124 extends around the high pitch speaker 30 and is connected to the fourth through hole 125. The high pitch auxiliary path 31 extends along the third trench 124 and the fourth through hole 125, and leaves the first layer structure 11. In one embodiment, at least a portion of the third trench 124 surrounds the low pitch speaker 20.

With reference to FIGS. 4A and 4B, in this embodiment, the third through hole 123 is adjacent to the fourth through hole 125. The second through hole 121 is located between the low pitch speaker 20 and the high pitch speaker 30. The low pitch speaker 20 is located between the second through hole 121 and the third through hole 123. In other words, the comb-shaped portion 122A, the second through hole 121, the third through hole 123 and the fourth through hole 125 are arranged around the low pitch speaker 20.

Utilizing the headphone of the embodiment of the invention with the crossfeed speaker, both the left ear and the right ear of the user can hear the sound of the right sound channel and the left sound channel. The design of the path length and the shapes of the first trench, the second trench and the third trench modify the time difference of the sound therein. Additionally, the frequency can be modified by the design of breathable holes and the first trench.

In one embodiment, when the volume of the low pitch speaker 20 and the high pitch speaker 30 is high, the volume of the crossfeed speaker 40 is low. When the volume of the low pitch speaker 20 and the high pitch speaker 30 is low, the volume of the crossfeed speaker 40 is high. Therefore, stereo sound is provided.

With reference to FIG. 1A, in one embodiment, the headphone further includes a vent 15. The vent 15 is formed on a side of the housing 10, and communicates with outside air.

Figure 5A:
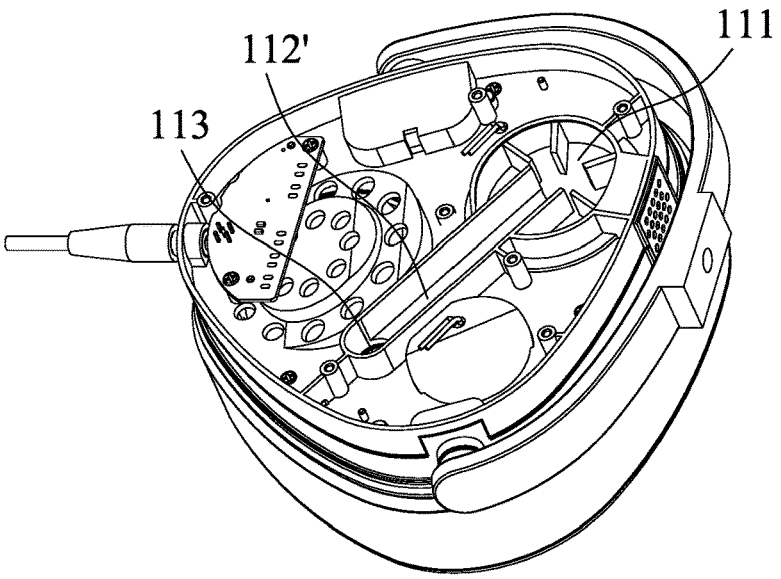
FIGS. 5A and 5B show a headphone of another embodiment of the invention.
Figure 5B:
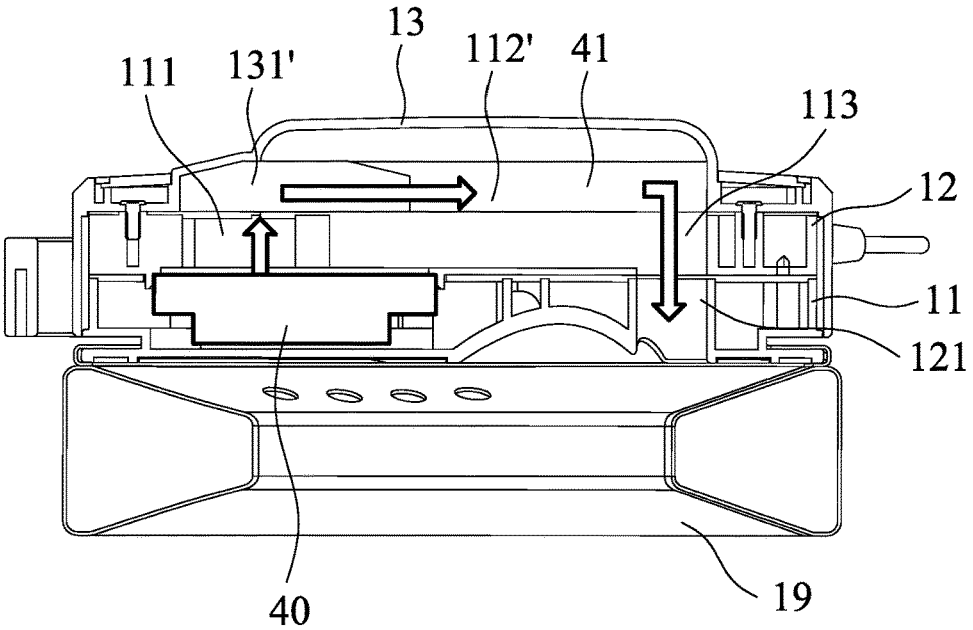

FIGS. 5A and 5B shows a headphone of another embodiment of the invention, wherein the crossfeed output path 41 extends between the second layer structure 12 and the cover structure 13, and passes through the second layer structure 12 and the first layer structure 11 to the sound output side 19. The second layer structure 12 includes an opening portion 111, a second trench 112' and a first through hole 113. The opening portion 111 corresponds to the crossfeed speaker 40. The second trench 122' is communicated to the opening portion 111 and the first through hole 113. The crossfeed output path 41 extends along the opening portion 111, the second trench 112' and the first through hole 113 to leave the second layer structure 12. The cover structure 13 includes a sound chamber 131'. The sound chamber 131' is connected to the opening portion 111 and the second trench 112'. The crossfeed output path 41 travels from the opening portion 111, the sound chamber 131', the second trench 112' and the first through hole 113 to leave the second layer structure 12. The sound chamber 131' is utilized to modify the frequency characteristics.

Figure 6:
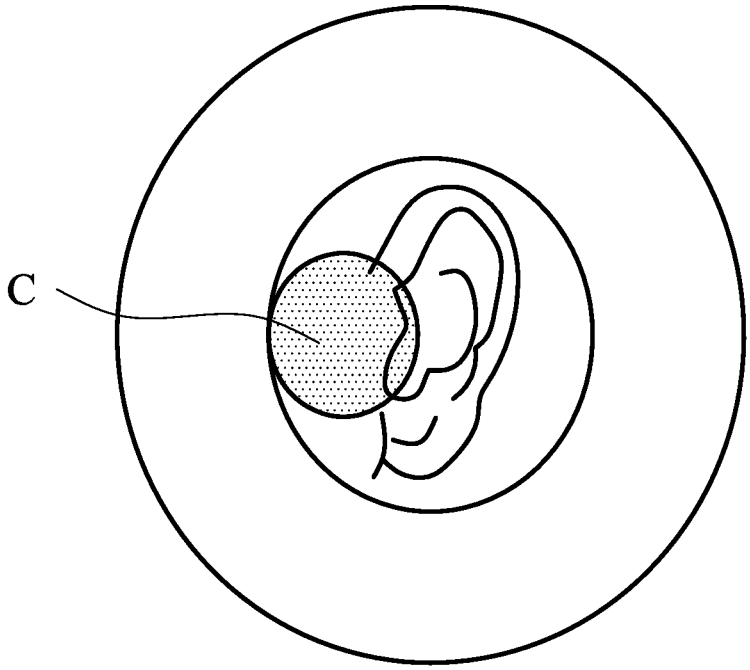
FIG. 6 shows a sound field center of the embodiment of the invention.

With reference to FIG. 6, in one embodiment, the low pitch speaker 20, the high pitch speaker 30 and the crossfeed speaker 40 have small dimensions, and a sound field center C can be located in front of an ear canal.

Figure 7:
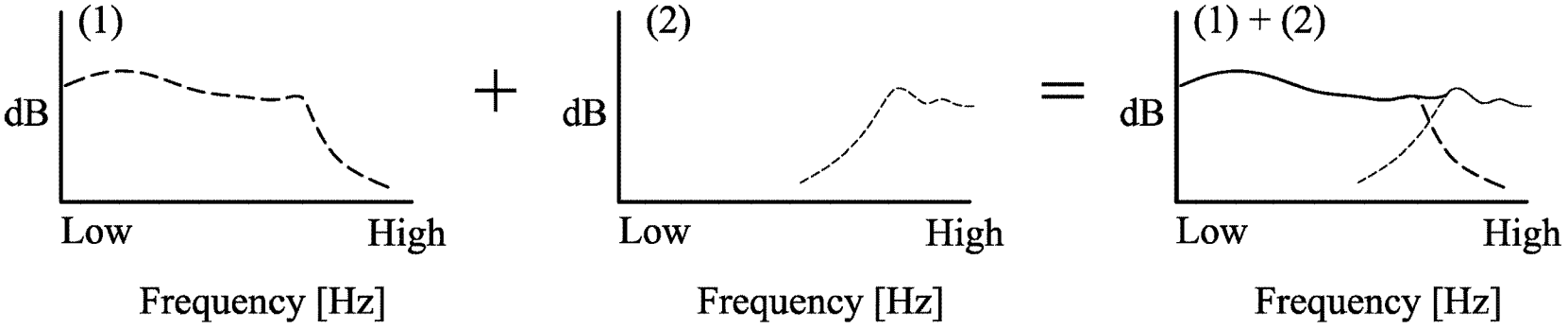
FIG. 7 shows the crossfeed sound combined by the low pitch sound and the high pitch sound.

With reference to FIG. 7, in one embodiment, the crossfeed sound is combined by the high pitch sound and the low pitch sound by an electronic sound filter and head-related transfer function theory, and to provide an improved feeling of localization.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A headphone, comprising:

a housing, comprising a sound output side, a first layer structure, a first output path, a first trench, a first recess and a second recess;

a first speaker, disposed in the first recess, wherein the first speaker comprises a first speaker orientation, a first inclined surface, and the first speaker orientation corresponds to the first output path; and a second speaker, disposed in the second recess, wherein the first output path comprises the first trench, wherein the first trench is located at the first layer structure, that extends around the first speaker, and is connected to the sound output side;

wherein the housing further comprises a second output path, the first speaker comprises a second speaker orientation, and the second speaker orientation corresponds to the second output path, and wherein the housing further comprises a second layer structure and a cover structure and the first recess and the second recess are disposed in the second layer structure, wherein the first speaker is disposed in the first recess and is in contact with the first inclined surface and the first speaker orientation corresponds to the first output path, wherein the first speaker orientation corresponds to the first output path.

2. The headphone as claimed in claim 1, further comprising a crossfeed speaker, wherein the crossfeed speaker comprises a crossfeed speaker surface, the crossfeed speaker surface corresponds to a crossfeed output path, and the first speaker, the second speaker and the crossfeed speaker are disposed between the first and second layer structures.

3. The headphone as claimed in claim 2, wherein the housing further comprises a third output path and a fourth output path, the second speaker comprises a third speaker surface and a fourth speaker orientation, the first speaker and the second speaker are arranged at a tilt, the third and fourth speaker orientation respectively correspond to the third and fourth output path, and the lengths of the first and the third output paths are respectively longer than the lengths of the second and the fourth output paths.

4. The headphone as claimed in claim 3, wherein the second layer structure comprises a third recess, the first recess comprises the first inclined surface, the second recess comprises a second inclined surface, the first speaker in the first recess is in contact with the first inclined surface, the second speaker in the second recess is in contact with the second inclined surface, and the crossfeed speaker is disposed in the third recess.

5. The headphone as claimed in claim 4, wherein the first speaker, the second speaker and the crossfeed speaker are respectively attached in the first recess, the second recess and the third recess by magnetic force.

6. The headphone as claimed in claim 4, wherein the crossfeed output path extends between the second layer structure and the cover structure, and passes the second layer structure and the first layer structure to the sound output side, and the second layer structure comprises an opening portion, a second trench and a first through hole, the opening portion corresponds to the crossfeed speaker, the second trench communicates with the opening portion and the first through hole, and the crossfeed output path extends along the opening portion, the second trench and the first through hole, and leaves the second layer structure.

7. The headphone as claimed in claim 6, wherein the first layer structure comprises a second through hole, the second through hole corresponds to the first through hole, and the crossfeed output path travels from the second layer structure, passing the first layer structure to the sound output side along the first through hole and the second through hole.

8. The headphone as claimed in claim 6, wherein the first layer structure comprises a third through hole, the third through hole is connected to the first trench, and the first output path travels along the first trench and the third through hole to leave the first layer structure.

9. The headphone as claimed in claim 8, wherein the first layer structure further comprises a third trench and a fourth through hole, the third trench extends around the second speaker and is connected to the fourth through hole, and the third output path travels along the third trench and the fourth through hole to leave the first layer structure.

10. The headphone as claimed in claim 9, wherein at least a portion of the third trench extends around the first speaker.

11. The headphone as claimed in claim 10, wherein the third through hole is adjacent to the fourth through hole.

12. The headphone as claimed in claim 11, wherein the second through hole is located between the first speaker and the second speaker.

13. The headphone as claimed in claim 12, wherein the first speaker is located between the second through hole and the third through hole.

14. The headphone as claimed in claim 13, wherein the first trench comprises a comb-shaped portion, the comb-shaped portion, the second through hole, the third through hole and the fourth through hole are arranged around the first speaker.

15. The headphone as claimed in claim 6, wherein the second output path extends in the first layer structure and passes through the first layer structure to the sound output side.

16. The headphone as claimed in claim 6, wherein the cover structure comprises a sound chamber, the sound chamber communicates with the opening portion and the second trench, the crossfeed output path extends along the opening portion, the sound chamber, the second trench and the first through hole, and leaves the second layer structure.

17. The headphone as claimed in claim 2, wherein the first speaker provides a low pitch sound, the second speaker provides a high pitch sound, the crossfeed speaker provides a crossfeed sound, and the crossfeed sound is synthesized by the low pitch sound and the high pitch sound.

18. The headphone as claimed in claim 2, wherein the sound output side has a sound field center, and the sound field center is located in front of an ear canal.

19. The headphone as claimed in claim 17, wherein the crossfeed sound is combined by the high pitch sound and the low pitch sound by an electronic sound filter.

* * * * *